US010531757B2

(12) United States Patent
Ho

(10) Patent No.: US 10,531,757 B2
(45) Date of Patent: Jan. 14, 2020

(54) PLASTIC GARMENT HANGER WITH COLLAPSIBLE PLASTIC HOOK

(71) Applicant: Sourcing Solutions International Limited, Kowloon (HK)

(72) Inventor: Leung Ho, Kowloon (HK)

(73) Assignee: Sourcing Solutions International Limited, Kowloon (HK)

( * ) Notice: Subject to any disclaimer, the term of this patent is extended or adjusted under 35 U.S.C. 154(b) by 200 days.

(21) Appl. No.: 15/375,529

(22) Filed: Dec. 12, 2016

(65) Prior Publication Data

US 2018/0160833 A1 Jun. 14, 2018

(51) Int. Cl.

| | |
|---|---|
| ***A47G 25/32*** | (2006.01) |
| ***A47G 25/14*** | (2006.01) |
| ***A47G 25/38*** | (2006.01) |

(52) U.S. Cl.

CPC ..... *A47G 25/32* (2013.01); *A47G 25/1435* (2013.01); *A47G 25/38* (2013.01)

(58) Field of Classification Search

CPC .... A47G 25/32; A47G 25/1435; A47G 25/38; A47G 25/40; A47G 25/4015; A47G 25/14; A47G 25/1442; A47G 25/34; A47G 25/4023; A47G 25/403; A47G 25/4038; A47G 25/1407; A47G 25/1428

USPC ..... 223/88, 89, 90, 91, 92, 93, 94, 85; 40/322

See application file for complete search history.

(56) References Cited

U.S. PATENT DOCUMENTS

| | | | | |
|---|---|---|---|---|
| 881,818 | A | 3/1908 | Morrison | |
| 1,893,815 | A | 10/1930 | Wilt, Jr. | |
| 2,425,527 | A | 7/1945 | Gaudino | |
| 3,082,921 | A | 3/1963 | Sadowsky | |
| 3,726,452 | A | 4/1973 | Jaffe | |
| 3,790,046 | A | 2/1974 | Rooney | |
| 4,063,670 | A | 12/1977 | Faarbech | |
| 4,168,791 | A | 9/1979 | Clark, Jr. | |
| 4,813,581 | A * | 3/1989 | LaMont | A47G 25/4023 223/94 |
| 4,905,877 | A | 3/1990 | Gatling | |
| 4,932,571 | A | 6/1990 | Blanchard | |
| 4,997,115 | A | 3/1991 | Jolley | |
| 5,007,562 | A | 4/1991 | Brink | |
| 5,044,534 | A | 9/1991 | Hwang | |
| 5,074,445 | A | 12/1991 | Chen | |
| 5,085,357 | A | 2/1992 | Chen | |
| 5,183,190 | A * | 2/1993 | Zuckerman | A47G 25/32 223/89 |
| 5,785,216 | A * | 7/1998 | Gouldson | A47G 25/1407 223/85 |
| 6,000,587 | A | 12/1999 | Sackett | |
| 6,050,460 | A | 4/2000 | Licari | |
| D518,653 | S | 4/2006 | de Groot | |
| 7,021,507 | B2 | 4/2006 | Choi | |
| D541,537 | S | 5/2007 | Cresap | |

(Continued)

FOREIGN PATENT DOCUMENTS

| | | |
|---|---|---|
| WO | WO9846107 | 10/1998 |

*Primary Examiner* — Anna K Kinsaul
*Assistant Examiner* — F Griffin Hall
(74) *Attorney, Agent, or Firm* — Schroeder Law PC

(57) ABSTRACT

A plastic garment hanger having a plastic hook moveable between an upright position for displaying garments and a folded position for reducing the footprint of the hanger during packaging/transportation of pre-hung garments.

8 Claims, 10 Drawing Sheets

(56) References Cited

U.S. PATENT DOCUMENTS

| | | | | |
|---|---|---|---|---|
| 7,243,823 | B2 | 7/2007 | Cresap | |
| 7,246,729 | B2 | 7/2007 | Harvey | |
| 7,249,699 | B2 | 7/2007 | Hill | |
| 7,828,179 | B2 | 11/2010 | Sprovieri | |
| 7,837,074 | B2 | 11/2010 | Rude | |
| D631,672 | S | 2/2011 | Kaleta | |
| 8,113,393 | B2 | 2/2012 | Ho | |
| 8,113,394 | B2 * | 2/2012 | Ho | G09F 3/20 223/85 |
| 8,381,952 | B2 | 2/2013 | Mainetti | |
| 8,523,026 | B2 | 9/2013 | Tseng | |
| 9,113,736 | B1 | 8/2015 | Antler | |
| 9,392,898 | B2 | 7/2016 | Tsukada | |
| 9,445,679 | B2 | 9/2016 | Hansen | |
| D814,199 | S * | 4/2018 | Ho | D6/328 |
| D814,200 | S * | 4/2018 | Ho | D6/328 |
| D814,808 | S * | 4/2018 | Ho | D6/328 |
| D826,583 | S * | 8/2018 | Ho | D6/328 |
| D828,696 | S * | 9/2018 | Ho | D6/328 |
| 2012/0241481 | A1 | 9/2012 | Merandi | |
| 2013/0200113 | A1 | 8/2013 | Tashkin | |
| 2014/0158724 | A1 | 6/2014 | Merandi | |
| 2015/0230644 | A1 | 8/2015 | Kallet | |
| 2015/0297012 | A1 | 10/2015 | Yamada | |
| 2016/0088964 | A1 | 3/2016 | Hansen | |

* cited by examiner

PLASTIC GARMENT HANGER WITH COLLAPSIBLE PLASTIC HOOK

BACKGROUND OF THE INVENTION

The present invention relates to garment hangers and, more particularly, to a plastic garment hanger having a collapsible plastic hook.

Plastic garment hangers having plastic hooks are well-known in the art. These hangers are typically formed as an integral unit using an injection molding process. Thus, the orientation of the plastic hook is fixed with respect to the plastic body of the hanger.

Many garments that are manufactured oversees are pre-hung on a hanger, and then shipped to the United States as a hanger/garment combination. In other words, the garment is hung on the appropriate hanger at the manufacturing location (e.g., the Far East), packaged into a shipping box or container, and shipped to the United States. Upon delivery to the retail location, the retailer simply has to remove the pre-hung garments from the shipping box/container, and hang such pre-hung garments in the retail store. Thus, there is no need for the retailer to incur time and cost hanging the individual garments on individual hangers.

Although garments can be tightly packed within the mentioned packaging boxes/containers, those skilled in the art will appreciate that the hooks of the garment hangers take up a significant volume of space within such boxes/containers. This additional space, of course, translates into additional shipping costs.

There is therefore a need in the art for a plastic garment hanger having a plastic hook, which in addition to functioning as a conventional garment hanger in a retail location, is also capable of providing a reduced footprint during packaging/transportation.

SUMMARY OF THE INVENTION

The present invention, which addresses the needs of the prior art, provides a garment hanger. The garment hanger includes a plastic body portion for supporting a garment. The garment hanger further includes a plastic support structure extending from an edge of the body portion, the support structure including a hook base and a sizer-engaging web. The support structure defines an overall cross-sectional thickness $Z_1$ and at least a portion of the hook base defines a cross-sectional thickness X, and wherein cross-sectional thickness X is less than cross-sectional thickness $Z_1$. The garment hanger further includes a plastic hook having a rod-engaging end and an opposing base-engaging end, the base-engaging end being non-removably and rotatably connected to the base. The hook is rotatable between a first upright in-use position and a second folded stowage position. The hook defines an overall cross-sectional thickness $Z_2$ and the base-engaging end of the hook defines a cross-sectional thickness Y. The cross-sectional thickness $Z_1$ is substantially equal to cross-sectional thickness $Z_2$, and cross-sectional thickness X+cross-sectional thickness Y is substantially equal to cross-sectional thickness $Z_1$.

The present invention also provides a method of manufacturing a garment hanger. The method includes the step of providing a plastic body portion for supporting a garment, the body portion having a plastic support structure extending from an edge thereof. The support structure includes a hook base and a sizer-engaging web. The hook base includes a pin extending perpendicular therefrom. The method includes the further step of providing a plastic hook having a rod-engaging end and an opposing base-engaging end. The base-engaging end includes an aperture sized to rotatably receive the pin. The method includes the further step of positioning the base-engaging end of the hook against the hook base such that the pin extends through said aperture. Finally, the method includes the step of deforming the pin to non-removably and rotatably connect the hook to the hook base whereby the hook is rotatable between a first upright in-use position and a second folded stowage position.

The present invention provides a further method of manufacturing a garment hanger. The method includes the step of providing a plastic body portion for supporting a garment, the body portion having a plastic support structure extending from an edge thereof. The support structure includes a hook base and a sizer-engaging web. The hook base includes an aperture. The method includes the further step of providing a plastic hook having a rod-engaging end and an opposing base-engaging end. The base-engaging end includes a pin extending perpendicular therefrom, the pin being sized to rotatably extend through the aperture. The method includes the further step of positioning the base-engaging end of the hook against the hook base such that the pin extends through said aperture. Finally, the method includes the step of deforming the pin to non-removably and rotatably connect the hook to the hook base whereby the hook is rotatable between a first upright in-use position and a second folded stowage position.

As a result, the present invention provides a plastic garment hanger having a plastic hook, and method of manufacturing thereof, which in addition to functioning as a conventional garment hanger in a retail location, is also capable of providing a reduced footprint during packaging/transportation.

DETAILED DESCRIPTION OF THE INVENTION

Figure 1:
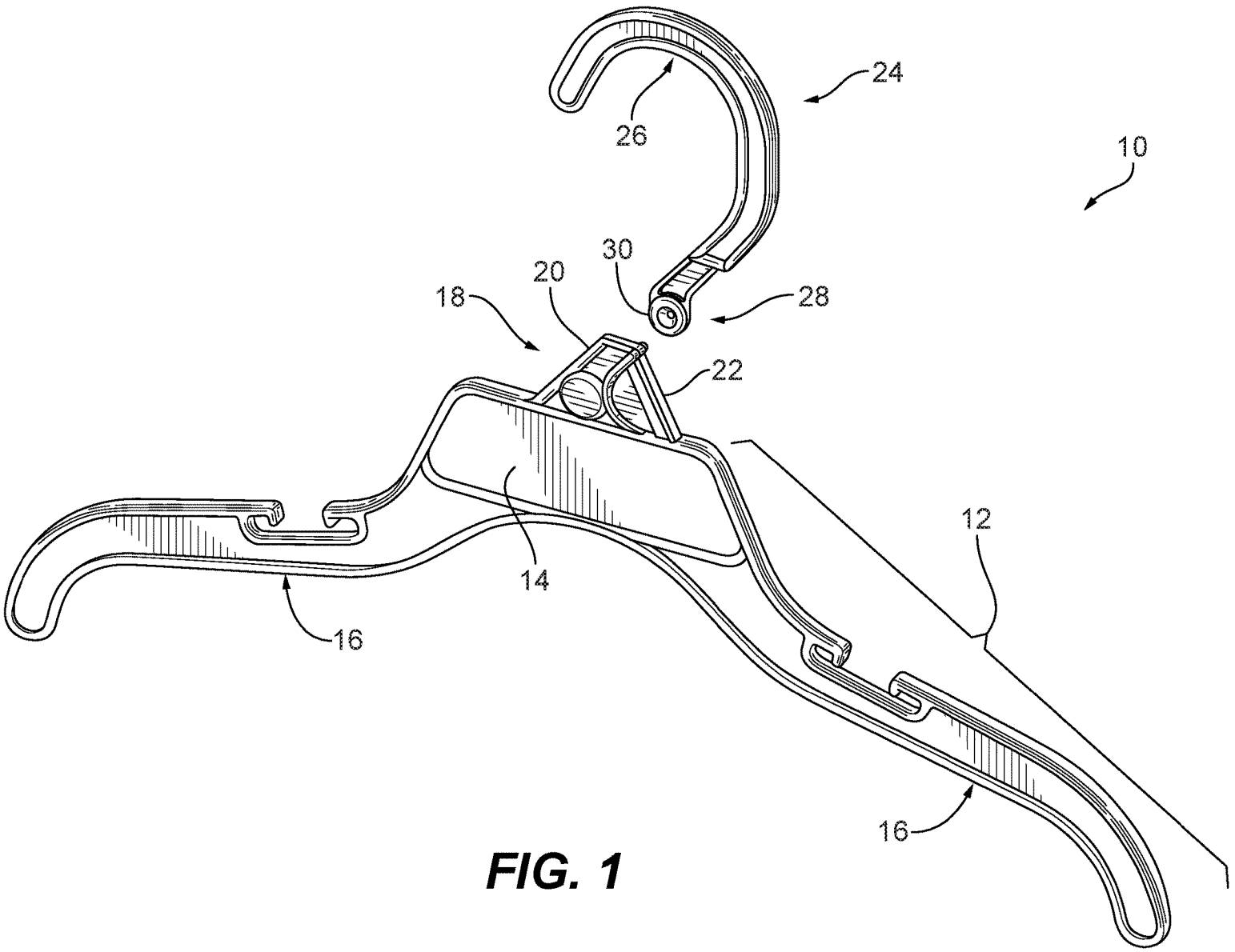
FIG. 1 is a front perspective view of a first embodiment of the plastic garment hanger of the present invention with the plastic hook exploded away from the plastic body.

A first embodiment of the present invention, i.e., hanger 10, is shown in FIGS. 1 to 6. Hanger 10 includes a plastic body portion 12 for supporting a garment. Body portion 12 in turn includes a central region 14 and a pair of opposing downwardly-depending arms 16. As depicted in FIG. 1, body portion 12 forms a continuous unitary structure and arms 16 are fixed with respect to one another. Hanger 10 further includes a plastic support structure 18 extending from an upper edge of body portion 12. Support structure 18 in turn includes a hook base 20 and a sizer-engaging web 22.

Figure 2:
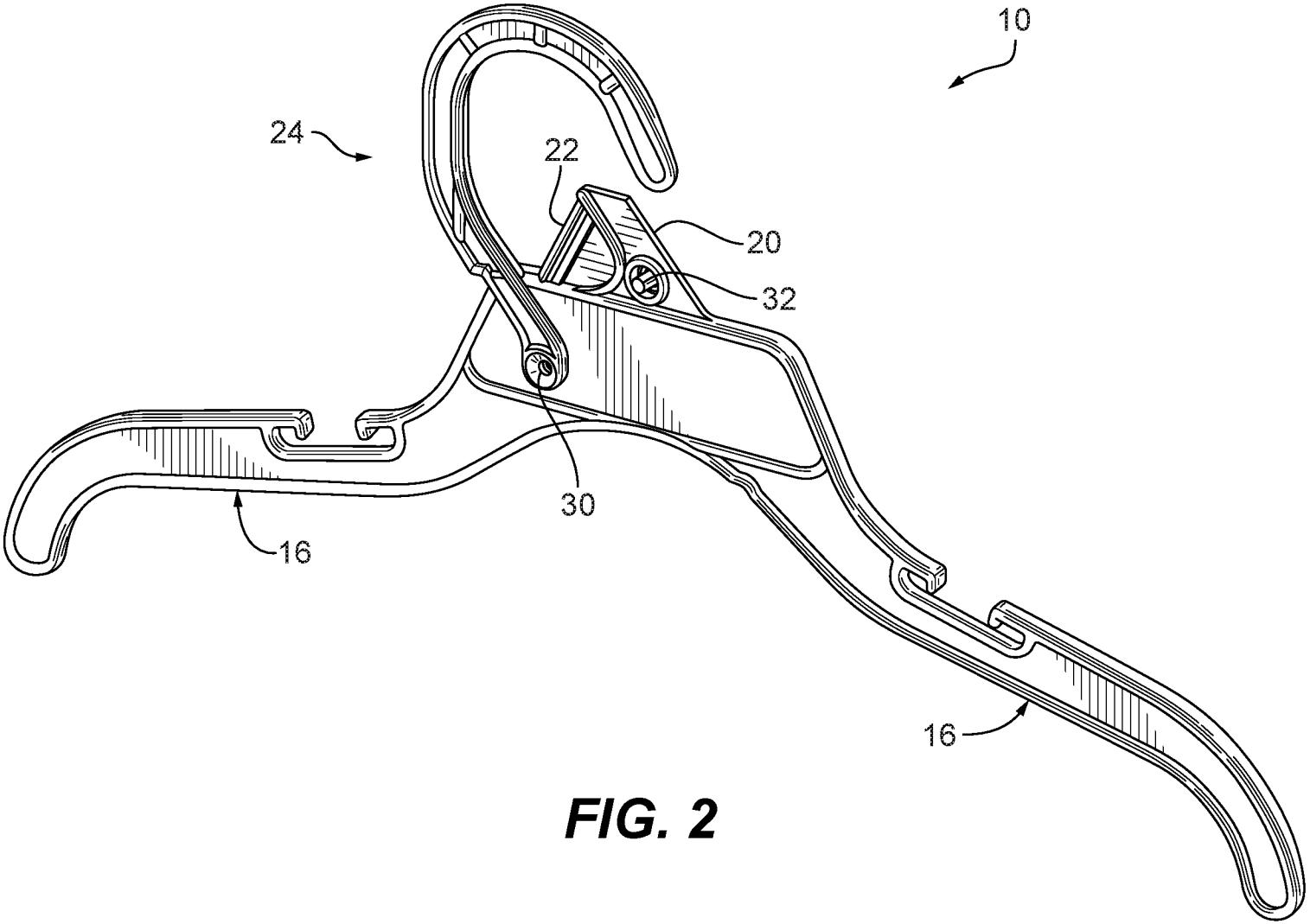
FIG. 2 is a rear perspective view of the plastic garment hanger of FIG. 1 with the plastic hook exploded away from the plastic body.
Figure 3:
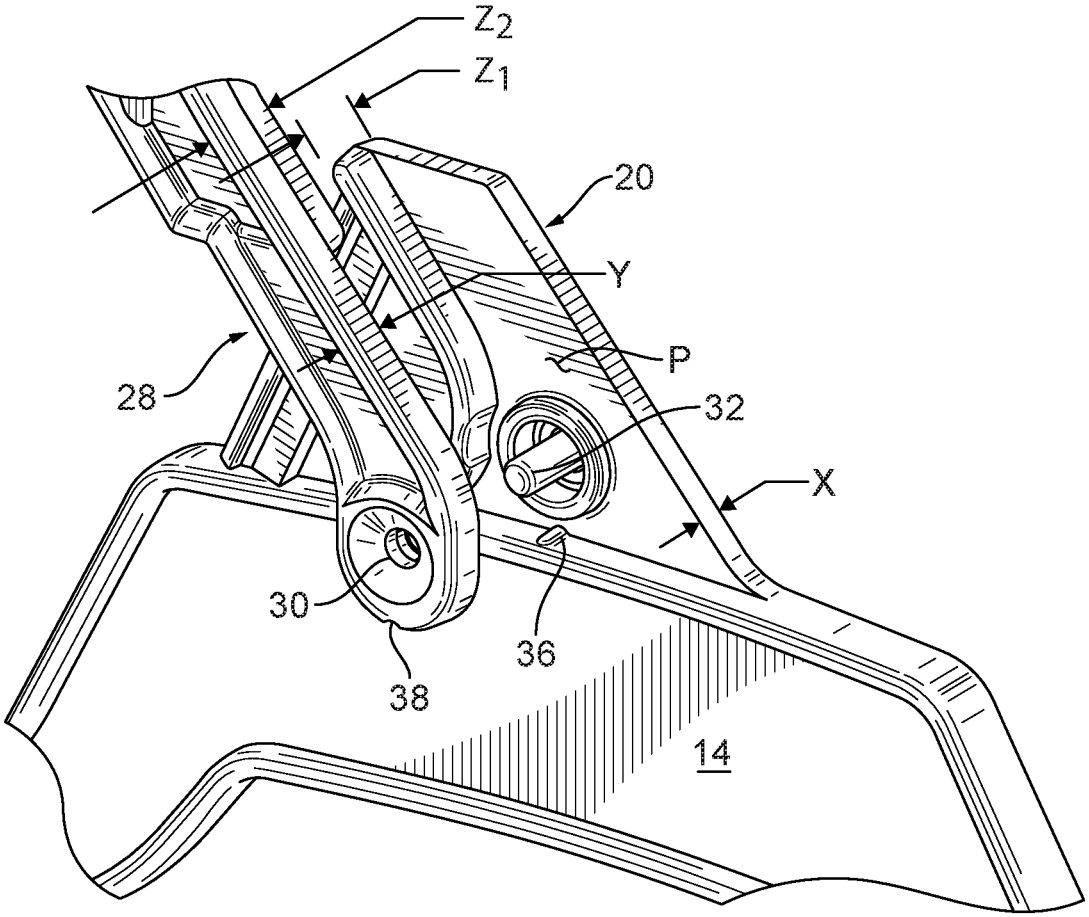
FIG. 3 is an enlarged view taken from FIG. 2.
Figure 4:
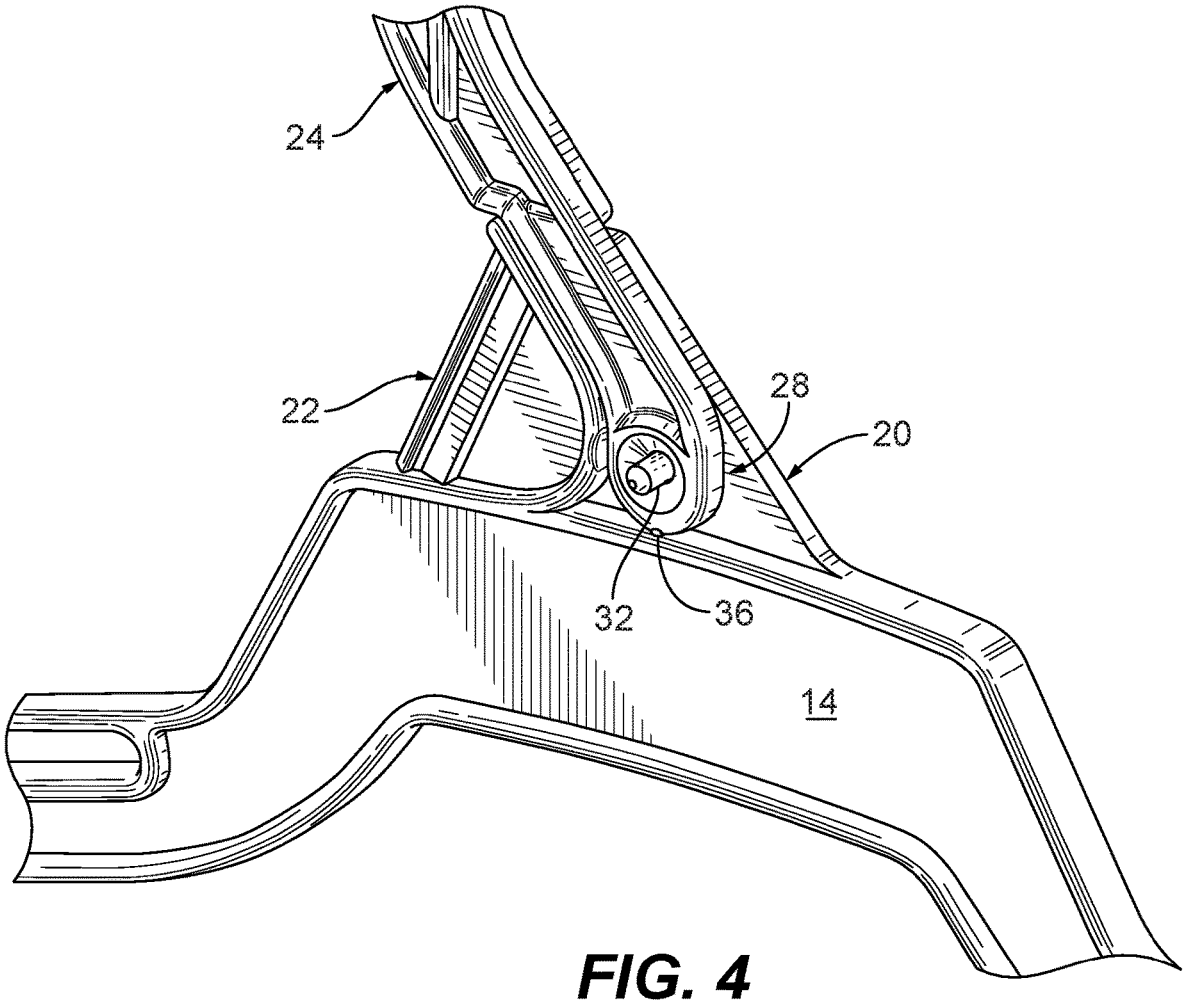
FIG. 4 is a rear perspective view of the plastic garment hanger of FIG. 1 showing the plastic hook positioned for assembly to the plastic hook base.
Figure 5:
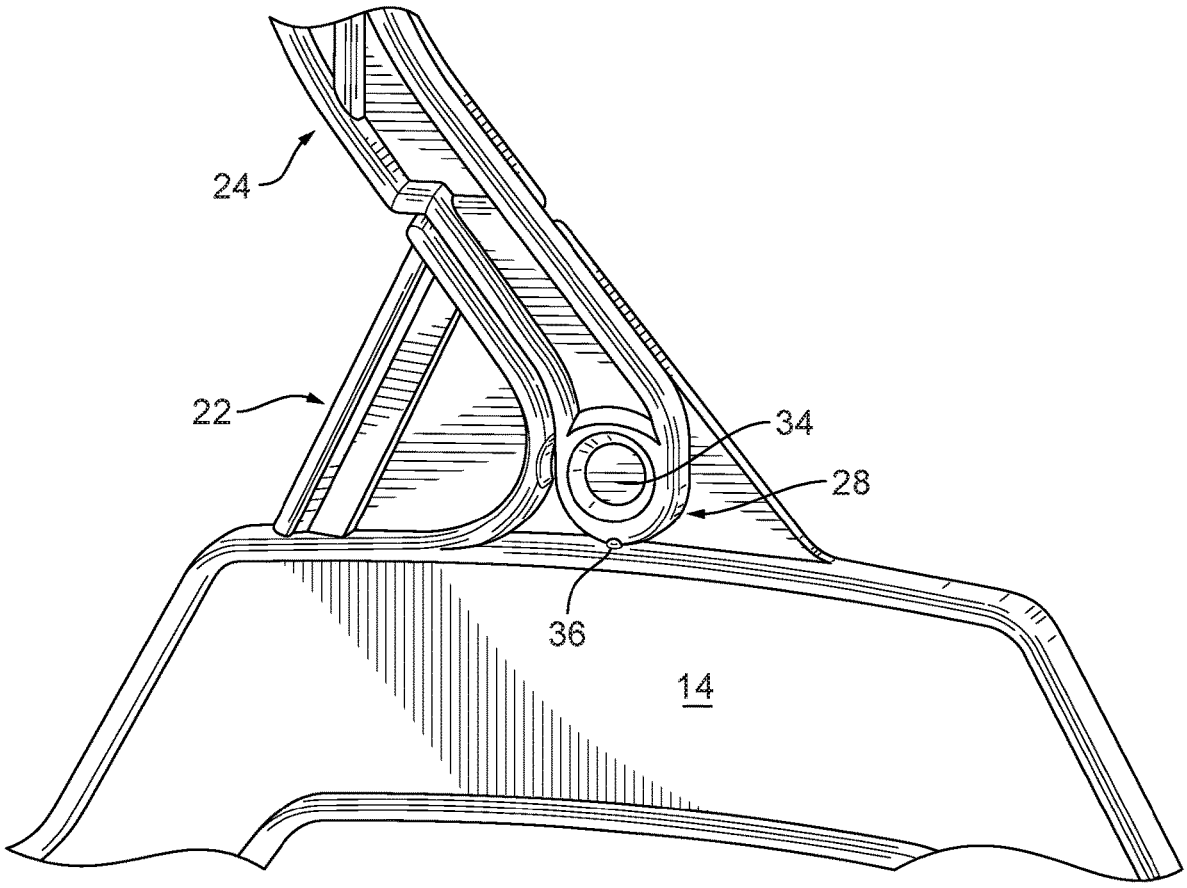
FIG. 5 is a rear perspective view of the plastic garment hanger of FIG. 1 showing the plastic hook non-removably and rotatably connected to the plastic hook base.
Figure 6:
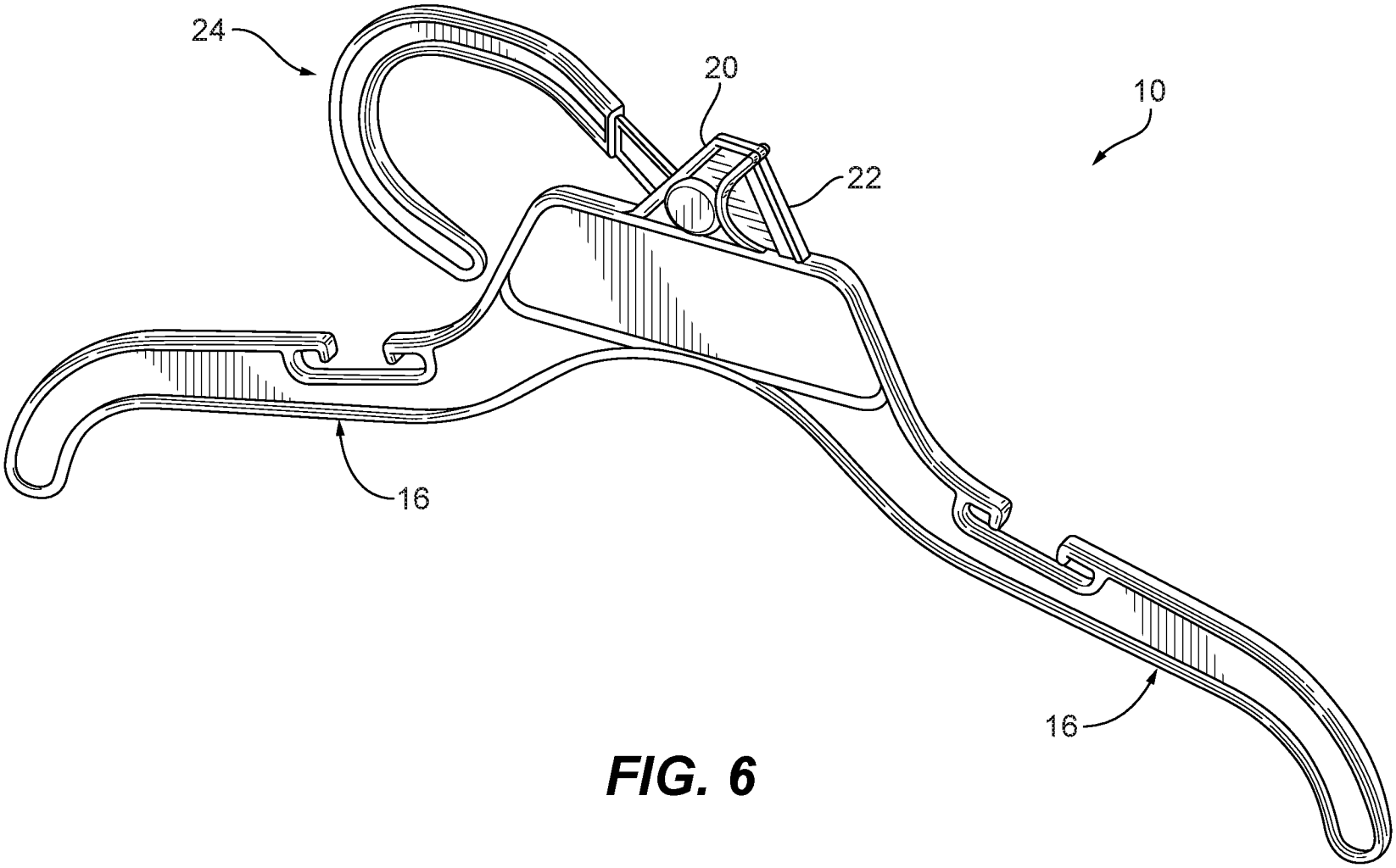
FIG. 6 is a front perspective view of the plastic garment hanger of FIG. 1 showing the plastic hook non-removably and rotatably connected to the plastic body, the plastic hook being shown in the second folded stowage position.
Figure 7:
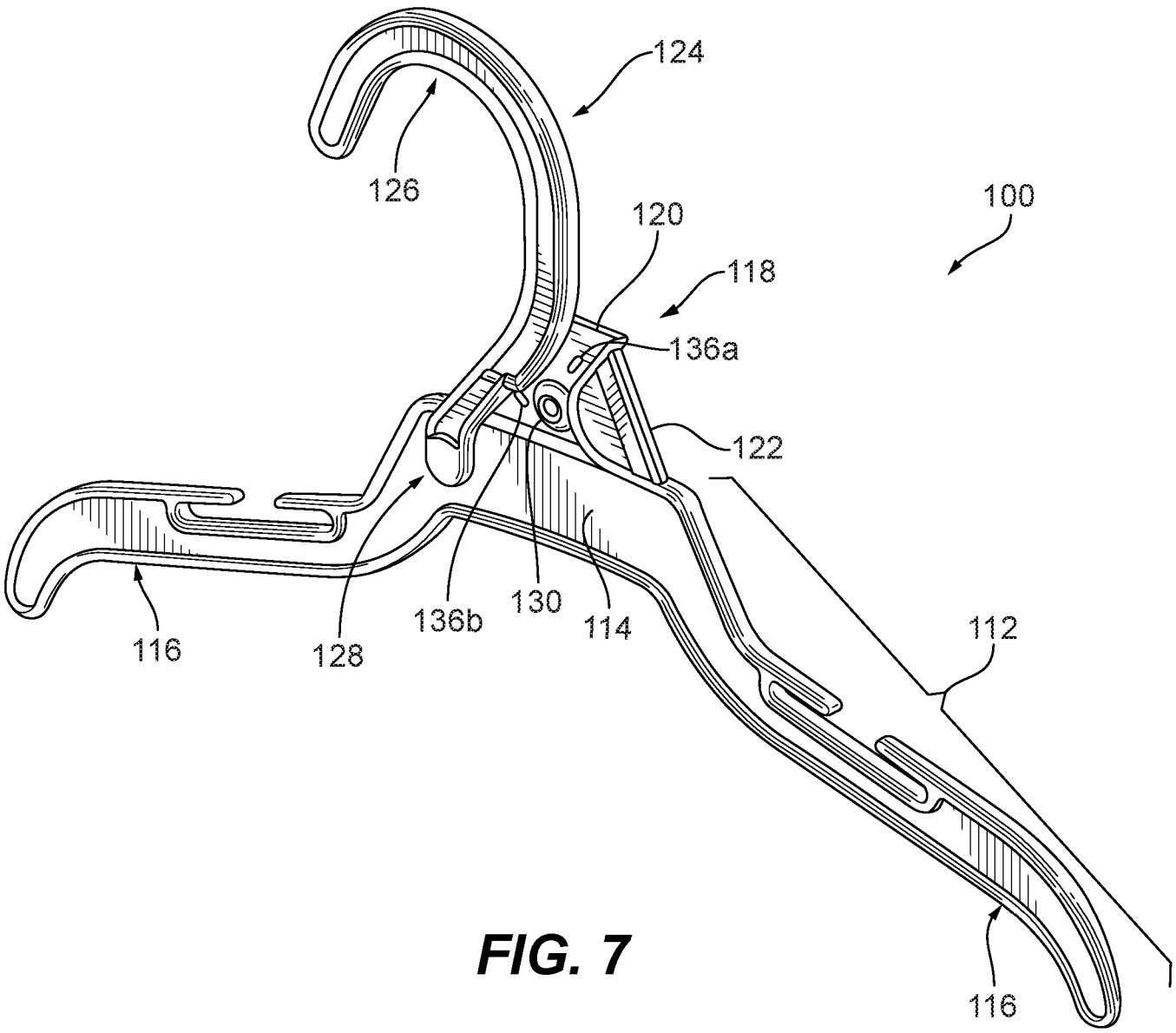
FIG. 7 is a front perspective view of a second embodiment of the plastic garment hanger of the present invention with the plastic hook exploded away from the plastic body.

Hanger 10 further includes a plastic hook 24. Plastic hook 24 in turn includes a rod-engaging end 26 and an opposing base-engaging end 28. An aperture 30 extends through base-engaging end 28. As best seen in FIGS. 2 to 3, a pin 32 extends outward from hook base 20 in a direction perpendicular to a plane P defined by hook base 20. Pin 32 is sized to rotatably extend through aperture 30. In particular, hook 24 is sized and configured to cooperate with support structure 18 whereby pin 32 extends through aperture 30 when base-engaging end 28 of hook 24 is positioned against hook (see FIG. 4).

After base-engaging end 28 of hook 24 is positioned against hook base 20 such that pin 32 extends through aperture 30, pin 32 is deformed to form a head 34 (see FIG. 5) which non-removably and rotatably connects hook 24 to hook base 20. Pin 32 may be deformed via mechanical action and/or the application of heat/pressure. Once hook 24 is rotatably connected to hook base 20, hook 24 may be rotated between a first upright in-use position (see FIG. 5) and a second folded stowage position (see FIG. 6). This folded state provides a reduced footprint for the hanger, thereby reducing the size of the packaging boxes/containers required to transport the garments positioned on the hangers. Once the garments reach the retail location, the pre-hung garments are removed from the boxes/containers, and the hook is rotated from the folded stowage position to the upright in-use position.

As best seen in FIG. 3, base-engaging end 28 of hook 24 has a cross-sectional thickness Y, while hook 24 has an overall cross-sectional thickness $Z_2$. As also shown in FIG. 3, support structure 18 has a cross-sectional thickness $Z_1$, while at least a portion of hook base 20 as a cross-sectional thickness X. In one preferred embodiment, cross-sectional thickness $Z_1$ is substantially equal to cross-sectional thickness $Z_2$, and cross-sectional thickness X+cross-sectional thickness Y is substantially equal to cross-sectional thickness $Z_1$. In this manner, the hook presents a substantially uniform cross-sectional thickness when in the upright in-use position. More to the point, the hanger, and particularly the hook, present the substantially same visual appearance to the customer (as a conventional plastic hook hanger) while in use displaying a garment.

Hanger 10 may also include a locking mechanism for securing the hook in the upright in-use position. In one embodiment, the locking mechanism includes a catch 36 positioned to engage a notch 38 formed in the lower edge of base-engaging end 28 of hook 24 (see FIG. 3). When hook 24 is rotated to the upright in-use position, catch 36 engages notches 38—thus frictionally securing the hook in the upright in-use position. Of course, it is contemplated herein that other mechanically cooperating structure may be located on the hook and/or support structure to secure the hook in one or both of the mentioned positions.

A second embodiment of the present invention, i.e., hanger 100, is shown in FIGS. 7 to 10. Hanger 100 includes a plastic body portion 112 for supporting a garment. Body portion 112 in turn includes a central region 114 and a pair of opposing downwardly-depending arms 116. Hanger 100 further includes a plastic support structure 118 extending from an upper edge of body portion 112. Support structure 118 in turn includes a hook base 120 and a sizer-engaging web 122.

Figure 8:
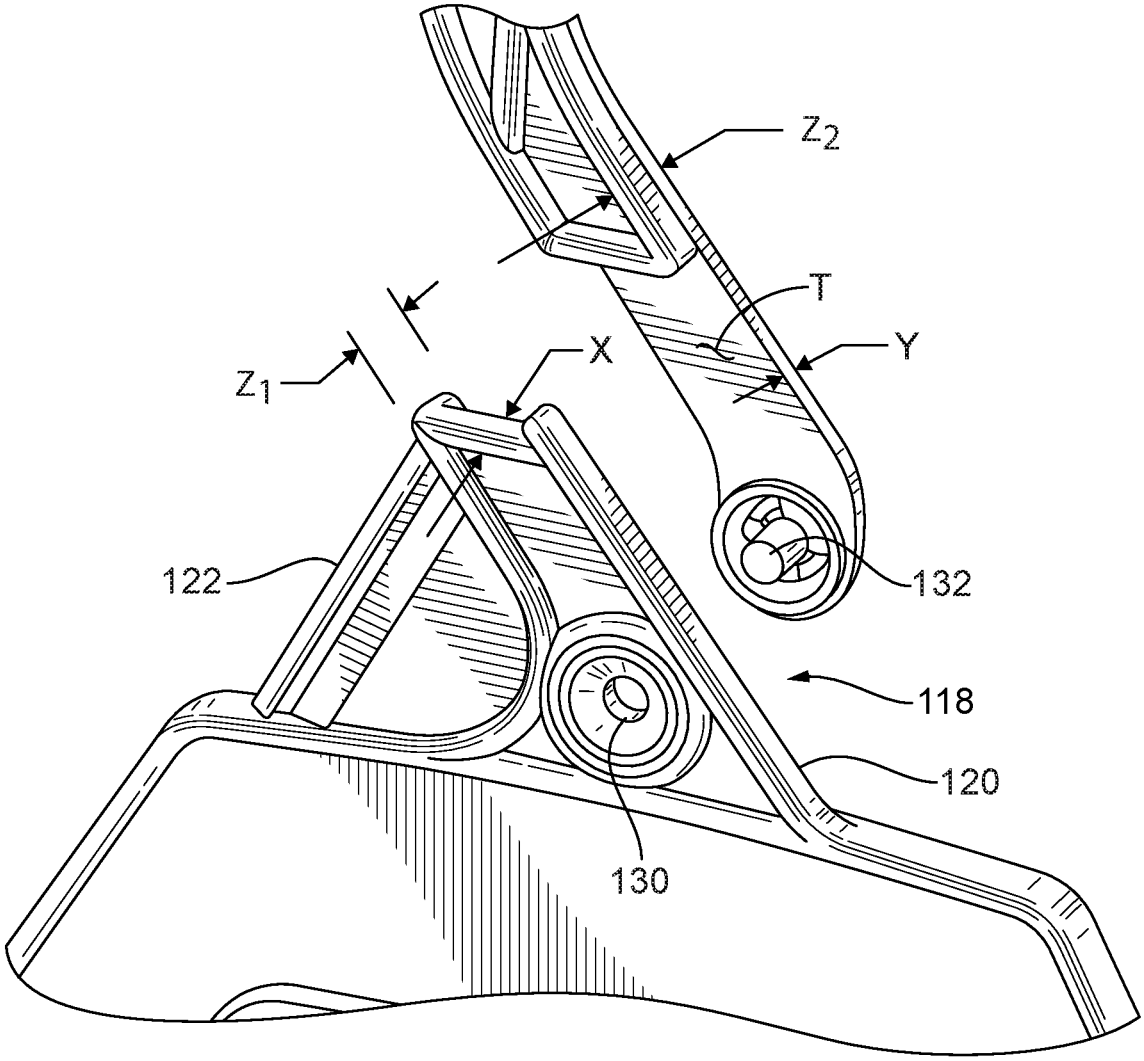
FIG. 8 is a rear perspective view of the plastic garment hanger of FIG. 7 with the plastic hook exploded away from the plastic body.
Figure 9:
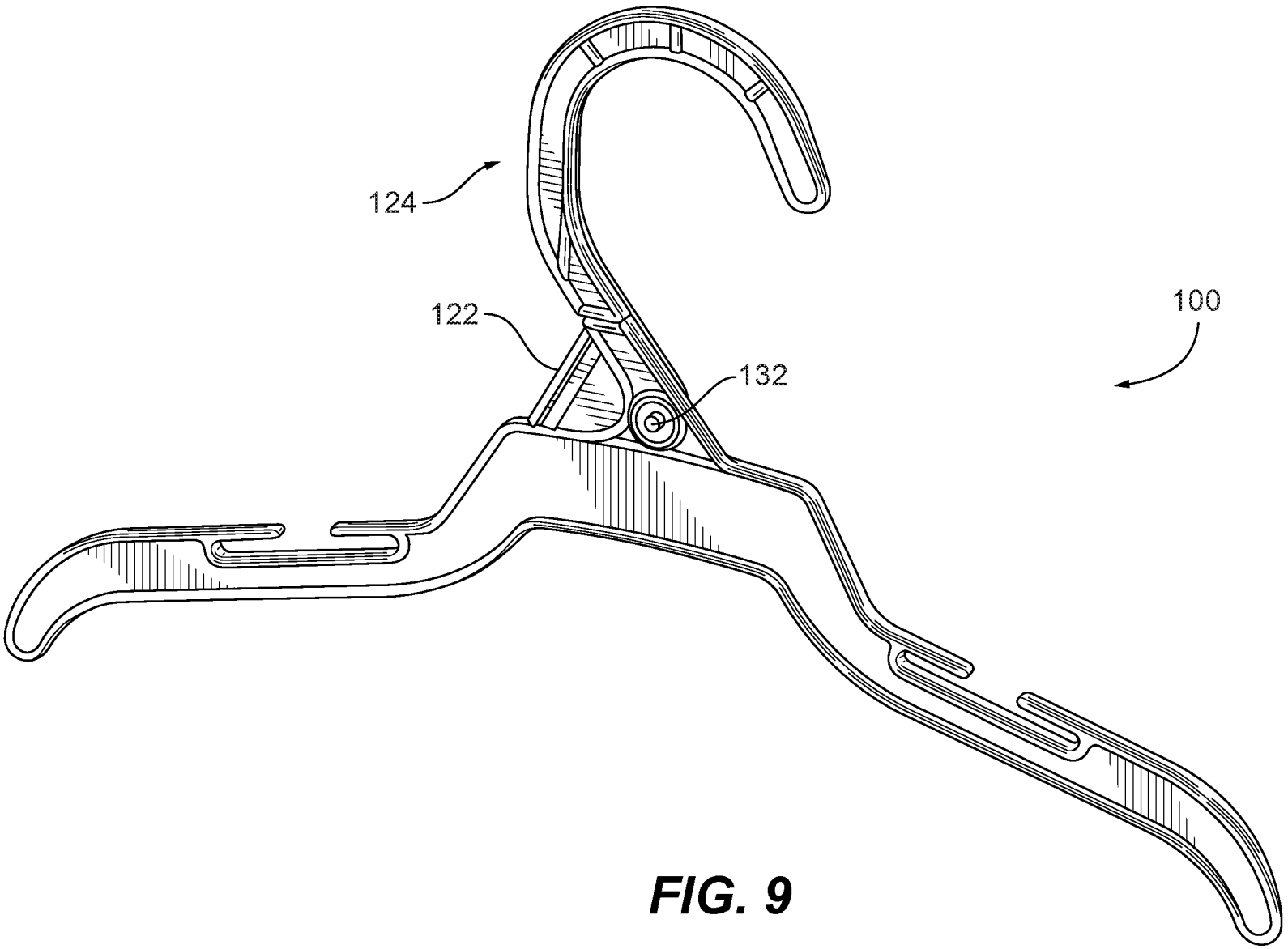
FIG. 9 is a rear perspective view of the plastic garment hanger of FIG. 7 showing the plastic hook positioned for assembly to the plastic hook base.
Figure 10:
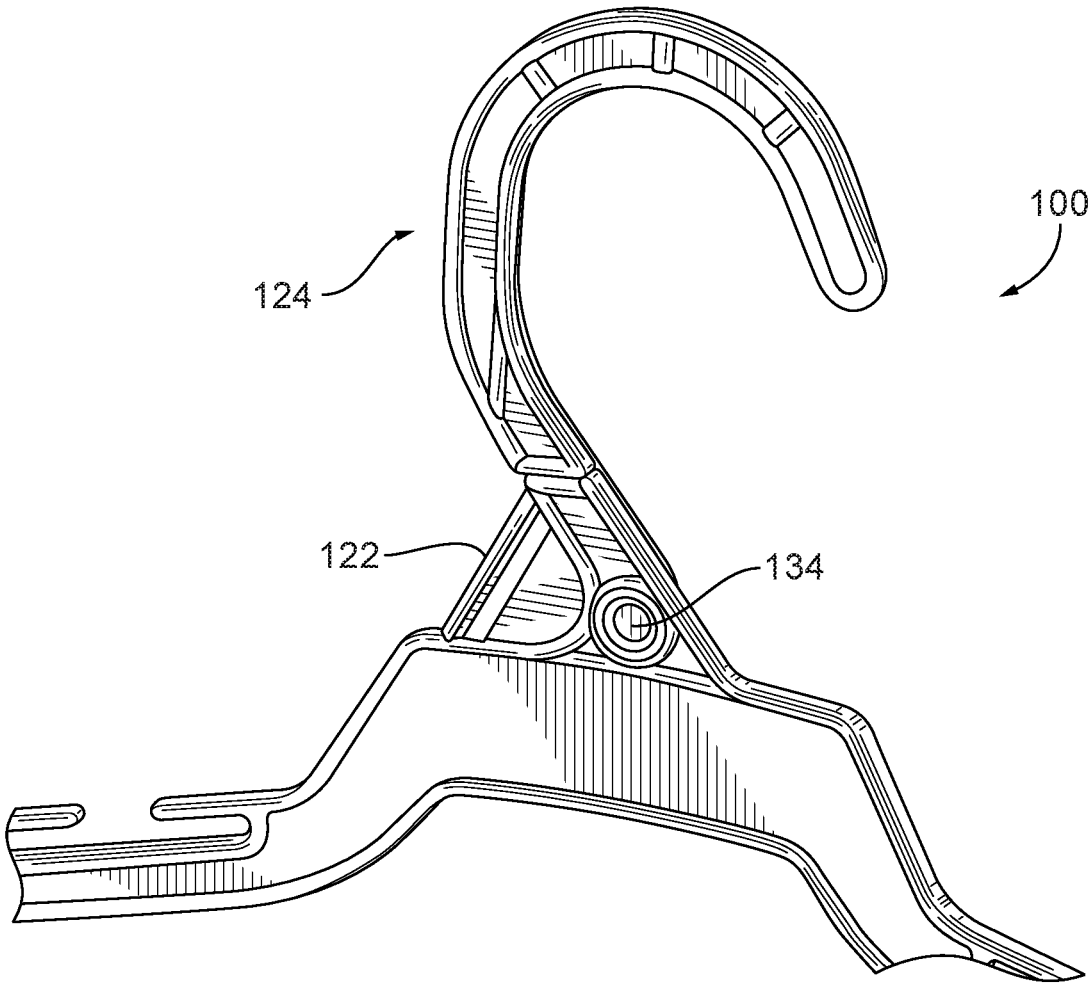
FIG. 10 is a rear perspective view of the plastic garment hanger of FIG. 7 showing the plastic hook non-removably and rotatably connected to the plastic body.

Hanger 100 further includes a plastic hook 124. Plastic hook 124 in turn includes a rod-engaging end 126 and an opposing base-engaging end 128. An aperture 130 extends through hook base 120. As best seen in FIG. 8, a pin 132 extends outward from base-engaging end 128 of hook 124 in a direction perpendicular to a plane T defined by hook 124. Pin 132 is sized to rotatably extend through aperture 130. In particular, hook 124 is sized and configured to cooperate with support structure 118 whereby pin 132 extends through aperture 130 when base-engaging end 128 of hook 124 is positioned against hook base 120 (see FIG. 9)

After base-engaging end 128 of hook 124 is positioned against hook base 120 such that pin 132 extends through aperture 130, pin 132 is deformed to form a head 134 (see FIG. 10) which non-removably and rotatably connects hook 124 to hook base 120. Pin 132 may be deformed via mechanical action and/or the application of heat/pressure. Once hook 124 is rotatably connected to hook base 120, hook 124 may be rotated between a first upright in-use position (see FIG. 10) and a second folded stowage position (not shown).

Hanger 100 may include a locking mechanism for securing the hook in the upright in-use position. In one embodiment, the locking mechanism includes protrusions **136*a* and 136*b* sized to engage at least an edge of said base-engaging end 128 of hook 124. When hook 124 is rotated to the upright in-use position, protrusion 136*a* engages an edge of base-engaging end 128—thus securing the hook in the upright in-use position. When hook 124 is rotated to the folded stowage position, protrusion 136*b* engages the opposing edge of base-engaging end 128**—thus securing the hook in the folded stowage position. Of course, it is contemplated herein that other mechanically cooperating structure may be located on the hook and/or support structure to secure the hook in one or both of the mentioned positions.

As best seen in FIG. 8, base-engaging end 128 of hook 124 has a cross-sectional thickness Y, while hook 124 has an overall cross-sectional thickness $Z_2$. As also shown in FIG. 8, support structure 118 has a cross-sectional thickness $Z_1$, while at least a portion of hook base 120 as a cross-sectional thickness X. In one preferred embodiment, cross-sectional thickness $Z_1$ is substantially equal to cross-sectional thickness $Z_2$, and cross-sectional thickness X+cross-sectional thickness Y is substantially equal to cross-sectional thickness $Z_1$. In this manner, the hanger, and particularly the hook, present the substantially same visual appearance to the customer (as a conventional plastic hook hanger) while in use displaying a garment.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendments and/or deviations be included in the scope of the present invention.

What is claimed is:

1. A garment hanger, comprising: a plastic body portion for supporting a garment, said body portion including a pair of opposing arms, said body portion forming a continuous unitary structure wherein said arms are fixed with respect to one another; a plastic support structure extending from an edge of said body portion, said support structure including a hook base and a sizer-engaging web, said support structure defining an overall cross-sectional thickness $Z_1$ and at least a portion of said hook base defining a cross-sectional thickness X, and wherein $X<Z_1$; a plastic hook having a rod-engaging end and an opposing base-engaging end, said base-engaging end being non-removably and rotatably connected to said hook base, said hook being rotatable between a first upright in-use position and a second folded stowage position, said hook defining an overall cross-sectional thickness $Z_2$ and said base-engaging end of said hook defining a cross-sectional thickness Y; and wherein $Z_1$ is substantially equal to $Z_2$, and wherein X+Y is substantially equal to $Z_1$.

2. The garment hanger according to claim 1, wherein said hook base includes a pin and said base-engaging end of said hook includes an aperture sized to rotatably receive said pin whereby said hook is rotatably connected to said hook base.

3. The garment hanger according to claim 2, wherein said pin includes a deformable head for non-removably securing said hook to said hook base.

4. The garment hanger according to claim 1, wherein said base-engaging end of said hook includes a pin and said hook base includes an aperture sized to rotatably receive said pin whereby said hook is rotatably connected to said hook base.

5. The garment hanger according to claim 4, wherein said pin includes a deformable head for non-removably securing said hook to said hook base.

6. The garment hanger according to claim 1, further comprising a locking mechanism for securing said hook in said first upright in-use position.

7. The garment hanger according to claim 6, wherein said hook base defines a plane P, and wherein said locking mechanism includes a protrusion extending outward from said plane P, said protrusion sized to engage at least an edge of said base-engaging end of said hook when said hook is rotated to said first upright in-use position.

8. The garment hanger according to claim 6, wherein said hook base defines a plane P, and wherein said locking mechanism includes a protrusion extending outward from said plane P and a detent formed in an outer edge of said base-engaging end of said hook, said protrusion sized to engage said detent when said hook is rotated to said first upright in-use position.

* * * * *